United States Patent [19]

Honkaniemi et al.

[11] 4,211,553

[45] Jul. 8, 1980

[54] METHOD OF REFINING OF MELTS BY MEANS OF A PULVEROUS SOLID MATERIAL AND/OR A GAS

[75] Inventors: Matti E. Honkaniemi, Tornio; Helge J. Krogerus, Pori; Launo L. Lilja, Pori; Juho K. Mäkinen, Pori; John H. Relander, Tornio; Frans H. Tuovinen, Ulvila, all of Finland

[73] Assignee: Outokumpu Oy, Helsinki, Finland

[21] Appl. No.: 914,216

[22] Filed: Jun. 9, 1978

[30] Foreign Application Priority Data

Jun. 21, 1977 [FI] Finland ..... 771947

[51] Int. Cl.[2] ..... C22B 9/00

[52] U.S. Cl. ..... 75/53; 75/93 R; 75/129

[58] Field of Search ..... 75/53, 93, 129, 61, 75/63, 65

[56] References Cited

U.S. PATENT DOCUMENTS

| | | | |
|---|---|---|---|
| 3,258,328 | 6/1966 | Goss | 75/53 |
| 3,322,530 | 5/1967 | Nakamura | 75/53 |

*Primary Examiner*—P. D. Rosenberg

*Attorney, Agent, or Firm*—Brooks, Haidt, Haffner & Delahunty

[57] ABSTRACT

A method and an apparatus for refining a melt by means of a pulverous solid material and a carrier gas, in which the pulverous solid material and gas are injected into a reactor while melt is poured into the reactor, the kinetic energy of the melt created by falling being utilized for mixing the pulverous reagent and the gas with the melt, and the agitation of the melt surface being attenuated by causing the flow of the injected pulverous reagent and gas and the flow of the melt being poured to impinge against each other from opposite directions in the reactor.

6 Claims, 3 Drawing Figures

METHOD OF REFINING OF MELTS BY MEANS OF A PULVEROUS SOLID MATERIAL AND/OR A GAS

BACKGROUND OF THE INVENTION

The present invention relates to a process and apparatus for the refining of melts by means of a pulverous solid material or a gas or both.

A pulverous reagent and a molten melt have previously been mixed with each other by many different methods, e.g. by injecting a pulverous reagent into a batch of molten metal in a ladle through a tuyere fixed to the ladle wall below the melt batch surface or through a tuyere formed at the base of the ladle. Surface injection lancets have also been used for injecting a pulverous reagent at a high velocity under the surface of a melt batch in the ladle or by pushing an injection lancet into a hot melt batch in the ladle and by injecting a pulverous reagent under the surface of the melt.

In the injection methods first mentioned, the mixing efficiency has, however, been rather low. Attempts have been made to improve it by using surface injection and very small-diameter nozzles in order to inject a pulverous material and a carrier gas into the melt at a high velocity, but in this case the powder has quickly worn out the nozzles. For this reason, lancets have been immersed in the melt; the lancets have been made straight and with a large diameter, in which case large non-dispersing gas bubbles are, however, produced in the melt, and solid material may rise to the melt surface inside these bubbles, without coming into contact with the melt. Furthermore, large bubbles cause strong agitation of the surface.

Also known is a mixing method in which a pulverous reagent is injected from above through a lancet lowered into the melt while melt is poured into the ladle. In this case the turbulence of the melt in the ladle promotes the mixing of the reagent with the melt. The lancet cannot, however, be lowered too close to the bottom of the ladle without the pulverous material beginning to cause wear of the ladle bottom. Even in this case there is splashing in the melt; this splashing can, however, be diminished by using the special nozzle disclosed in Finnish Patent Application No. 3167/74, which is, however, more expensive than an ordinary lancet.

The object of the present invention is thus to provide a method and apparatus for an effective and rapid mixing of a pulverous reagent and/or a gas with a hot melt without high injection velocities and resulting rapid wear of the nozzles and without significant melt surface agitation or splashing.

SUMMARY OF THE INVENTION

According to the invention there is provided a novel method for refining a melt by means of a pulverous solid and a gas, in which the kinetic energy of the melt created by falling is utilized for mixing the pulverous reagent and the gas with the melt, and the agitation of the melt surface is attenuated by causing the flow of the injected pulverous reagent and gas and the flow of the melt being poured to impinge against each other from substantially opposite directions in the reactor.

DESCRIPTION OF THE PREFERRED EMBODIMENTS

Figure 2:
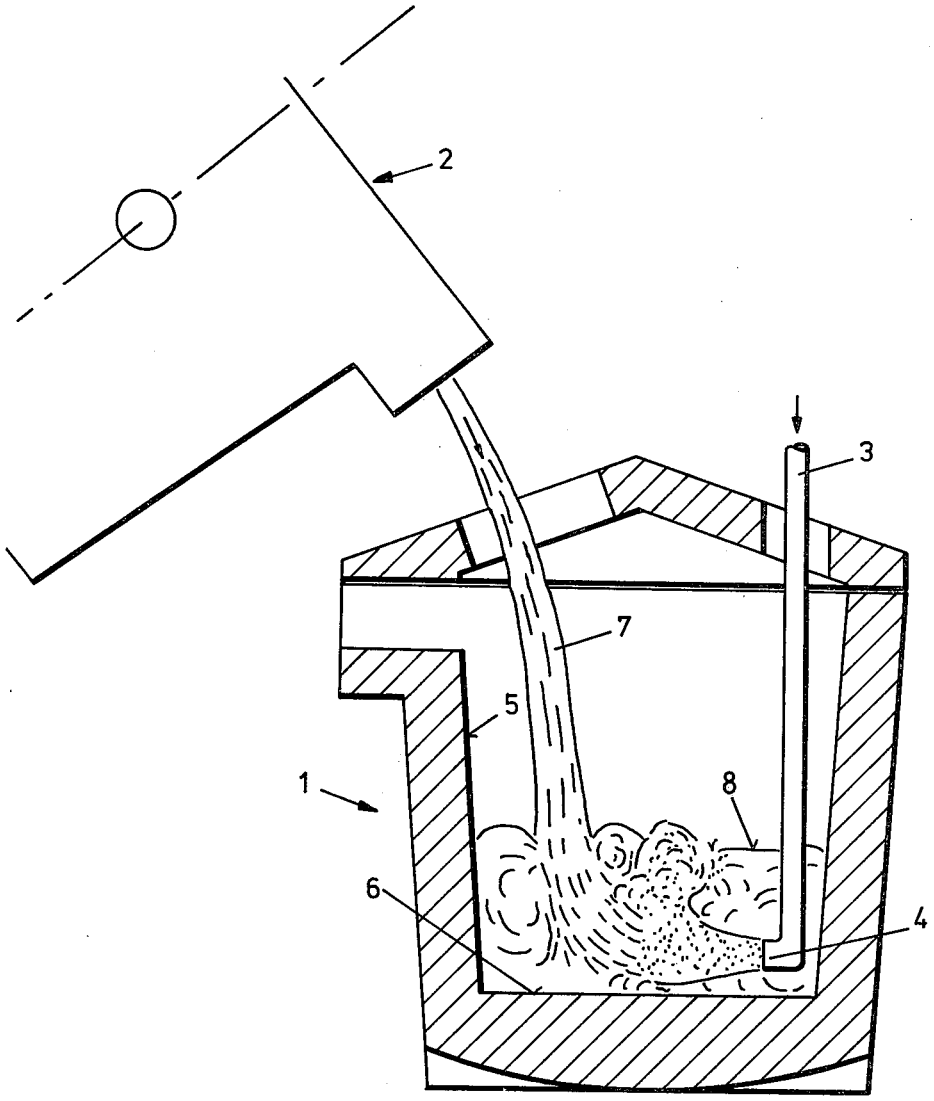
FIG. 2 illustrates a cross section of a side elevation of a mixing apparatus according to the invention.
Figure 3:
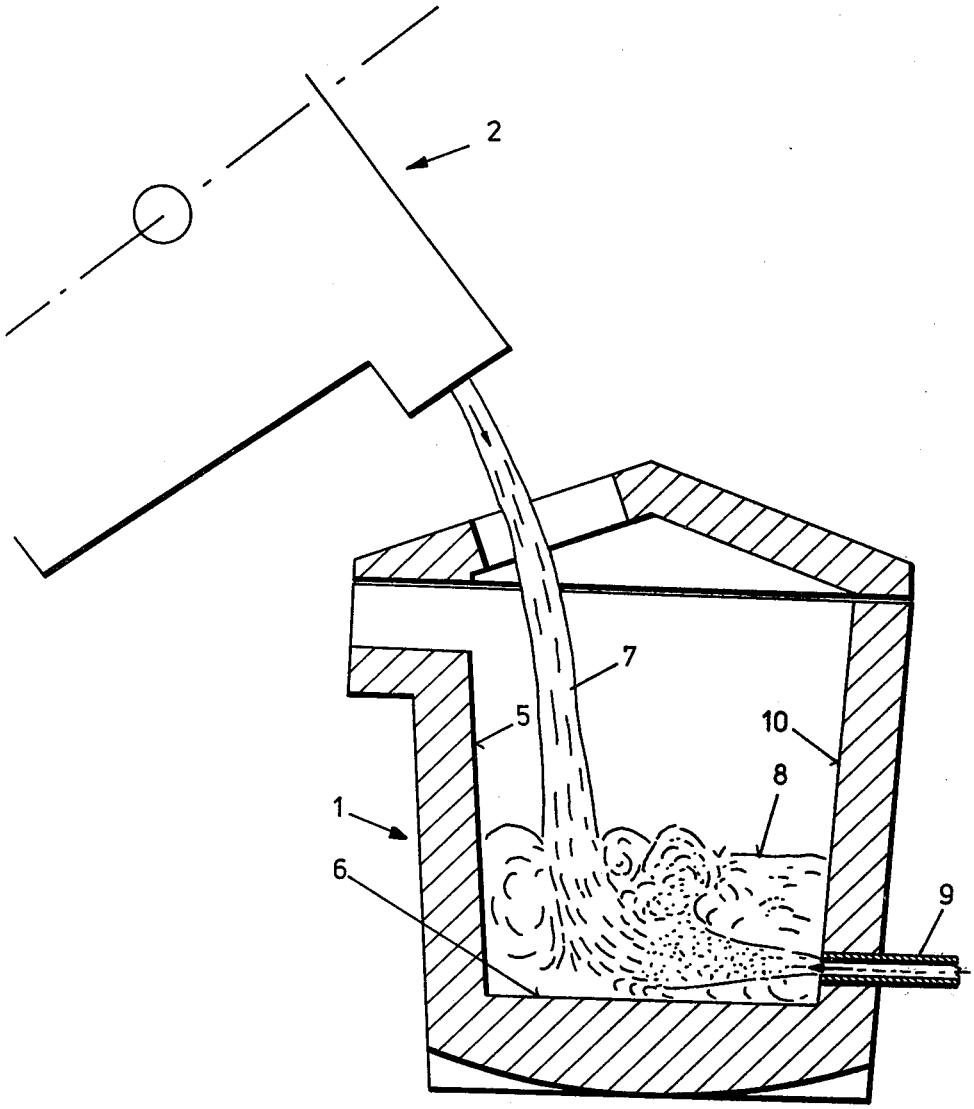
FIG. 3 depicts a cross section of a side elevation of an alternative arrangement for carrying out the method according to the invention.

In FIGS. 2 and 3, the tip-up ladle used as the reaction vessel is indicated by 1 and the pouring ladle by 2. In FIG. 2, a pulverous reagent is fed from above into the ladle by means of a lowerable, substantially vertical lancet 3, the lower end 4 of which turns more or less horizontally to inject a pulverous reagent along the bottom 6 of the ladle 1 towards its opposite wall 5. In the less expensive embodiment, shown in FIG. 3, the lancet 9 has been installed substantially horizontally through the wall 10, close to the bottom 6 of the ladle 1 in order to inject a pulverous reagent in a direction parallel to the bottom 6, towards the opposite wall 5 of the ladle.

As can clearly be seen in FIGS. 2 and 3, hot melt is poured from height h calculated from the surface 8 of the melt in the ladle 1, so that the falling melt 7 falls close to that wall 5 of the ladle 1 which is opposite to the injection point of the pulverous reagent, and thus the melt flow which becomes parallel to the bottom 6 of the ladle 1 impinges against the reagent spray countercurrent to it. Thereby the energy gained by the melt in pouring and the injection energy of the reagent are converted almost completely to mixing energy and cancel each other out so that no substantial agitation or splashing of the surface 8 can occur.

The injection of the pulverous reagent is preferably started simultaneously with the pouring of the melt, for it has been observed that the utilization of the pouring energy of the melt is at its most effective at the initial stage of the pouring. At first, melt can be poured from the pouring ladle 2 closer to the melt surface, and gradually the pouring height can be increased so that the falling melt penetrates more deeply into the melt and effectively encounters fresh reagent.

The mixing efficiency achieved by means of the apparatus shown in FIG. 2 is as good as that achieved by means of the apparatus shown in FIG. 3, but the apparatus shown in FIG. 3 is less expensive. The injection lancet shown in FIG. 2 requires a separate raising and lowering system, and in continual use the lancet does not long tolerate the high temperatures (above 1000° C.) prevailing in the molten metal bath.

Even though the ladle 1 shown in FIG. 3, with the lancet 9 installed through its wall 10, is not novel per se, but the manner in which it is used is novel; it must, however, be noted that in such known ladle types it has previously been necessary to use special mechanical closing members or to tip the ladle before the injection of the pulverous reagent is discontinued, in order to prevent the melt from flowing into the lancet 9. In the method according to the invention, no special closing members for the lancet 9 or tipping of the ladle 1 is necessary since the lancet 9 is closed by using as the pulverous reagent or as its component part a material which melts or sinters at the temperature of the melt in the ladle 1, and after the discontinuation of the carrier gas this material forms a stopper in the mouth of the injection tuyere or lancet 9. When the ladle has been emptied, the stopper in the mouth of the lancet can be removed by tapping or striking.

Figure 1:
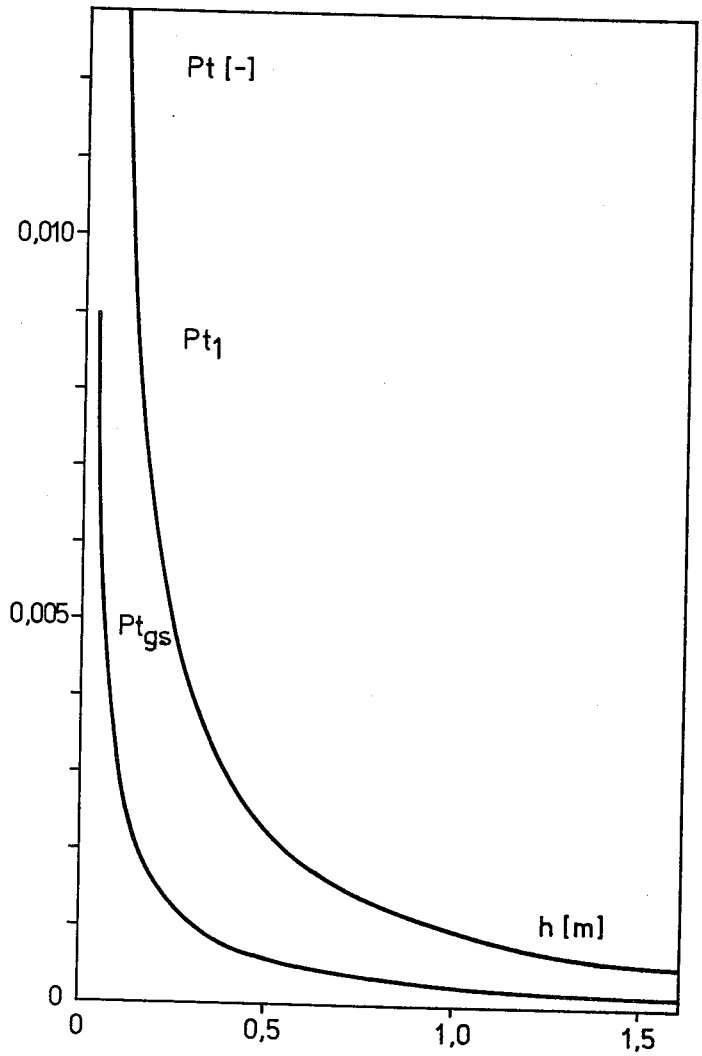
FIG. 1 depicts a theoretical mixing efficiency Pt as a function of the melt surface level h.

The curves depicted in FIG. 1 have been calculated and drawn on the basis of the following parameters:

Total melt quantity: 10 t of ferrochromium

Pouring time: 10 min

Pouring height (from the pouring ladle to the bottom of the sulfur removal ladle): 2.9 m Inner diameter of injection nozzle: 12 mm Carrier gas rate: 30 $m^3$/h of air Reagent rate: 25 kg/min CaO The acceleration (a) of the melt mass ($m_1$) can be taken as one parameter for determining the mixing of the melt. Furthermore, if the dimensionless quantity (Pt) is determined as a ratio of this acceleration (a) to the acceleration of gravity (g) the following dependencies can be given with the aid of the "impulses" ($F_1=m_1w_{11}$, $F_{gs}=m_{gs}w_{gs}$) of both the melt flow ($m_1$) being poured and, for the sake of comparison, of the solid-gas suspension quantity ($m_{gs}$) being fed through the nozzles:

$$Pt_1 = \frac{\dot{m}_1 w_{11}}{m_1 g} = \frac{\dot{m}_1 \sqrt{2g\Delta h}}{m_1 g} \quad (1)$$

$$Pt_{gs} = \frac{\dot{m}_{gs} w_{gs}}{m_1 g} = \frac{(1+\gamma)\rho_g A_\phi w_{gs}^2}{m_1 g} \quad (2)$$

$$P = \frac{Pt_1}{Pt_{gs}} = \frac{\dot{m}_1 \sqrt{2g\Delta h}}{(1+\gamma)\rho_g A_\phi w_{gs}^2} \quad (3)$$

where $w_{11}=\sqrt{2g\Delta h}$ is the velocity of the melt 7 when it falls on the melt surface 8, calculated on the basis of the formula of free fall movement for the falling height, $\Delta h$=distance from the pouring ladle 2 to the melt surface (8), $w_{gs}$=velocity of the suspension spray when it discharges from the nozzle 4,9, $A_\phi$=the internal cross section of area of the nozzle, $\rho_g$=density of the carrier gas, and $H=m_s/m_g$=reagent load in the carrier gas (kg/kg).

The effects $Pt_1$ and $Pt_{gs}$ have been calculated and drawn in FIG. 1 as functions of the height h of the melt in the ladle 1.

It is observed that in the example case the effect ($Pt_1$) produced by the melt flow is approx. four-fold compared with the effect ($Pt_{gs}$) produced by the reagent-gas suspension spray.

If the effect ($Pt_{gs}$) produced by the gas-reagent spray is desired to be equal to the effect ($Pt_1$) produced by the melt flow, in the example case this is achieved (h=1 m) by reducing the nozzle from $\phi$12 mm to $\phi$5.8 mm, whereby $w_{gs}$ increases from 56.3 m/s to 238 m/s. In practice this situation is not sensible because of the smaller nozzle size and the multiplication of the velocity, since the passage of the powder is encumbered and the wearing effect is increased.

If, for the sake of illustrating this matter, the powder is assumed to be entirely eliminated (H=0), and pure gas is injected at the rates mentioned above, when calculating in the manner shown above, P=1 when the diameter of the nozzle is diminished from $\phi$12 mm to $\phi$0.93 mm, whereby the velocity of the gas increases ($w_g=V_g/A_\phi$) from 56.3 m/s to "9447 m/s," i.e., the demands are too high even with pure gas.

The calculation example given above will give a clear picture of the extent of the "mixing aid" concerned when the "pouring energy" of the melt is used.

One method for illustrating the advantageousness of the method according to the invention is to observe the mixing phenomena on the basis of penetration, which means that it is calculated how deep into the melt it is possible for the gas spray to penetrate within sensible limits. For the sake of comparison, among the numerous possibilities the formulas given in V. A. Frolov: Izv. Vyss. Uceb. Zav. Cernaja Metallurgija (1967): 3, pp. 37–40 of horizontal injection can be used:

$$L/d = 1.2\sqrt{Ar} = 1.2\sqrt{\left(\frac{\rho_{gs}}{\rho_1 - {}_{gs}}\right)\frac{w_{gs}^2}{gd}} \quad (4)$$

$$S/d = 1.9\,Ar^{.47} = 1.9\left[\left(\frac{\rho_{gs}}{\rho_1 - \rho_{gs}}\right)\frac{w_{gs}^2}{gd}\right]^{0.47} \quad (5)$$

where L and S primarily indicate the penetration limits of the spray.

By placing the values $w_g$=56.3 m/s, $\phi$=12 mm and H=0 (i.e., $\rho_{gs}=\rho_g$=1.69 kg/$m^3$) of the example case in the formulas (4) and (5), we obtain L=37 mm and S=55 mm. Under the effect of the powder feed (H=38.7) the density increases ($\rho_{gs}$=67 kg/m'), for which reason the penetration also increases, i.e., L=233 mm and S=312 mm. This can be continued by imagining that the density increases further, whereby penetration thus also increases. By placing the "limit density" $\rho_{gs}=\rho_1$ finally in the formulas (4) and (5), i.e., by replacing the spray with a melt flow, we obtain $L \approx S \approx \infty$. This is naturally not valid in reality, but it gives a clear indication that the melt 7 being poured has substantially better possibilities for dispersing into the melt in the ladle than has a reagent-gas spray or a pure gas spray, i.e., it is easier to bring fresh melt into the vicinity of a suspension than vice versa.

The method according to the invention is described below in more detail with reference to FIG. 3, adapted to a case in which the melt is ferrochromium melt from which sulfur is removed using calcium oxide as the pulverous sulfur-removing reagent. It is evident that even other metal melts, such as impure copper, can be treated instead of ferrochromium melt.

After slagging and other necessary operations, the ferrochromium melt is poured into an injection ladle 1; in the wall 10 of this ladle 1, as close to the ladle bottom 6 as possible, there is a fixed injection nozzle 9, which is directed primarily horizontally towards the flow of melt poured close to the wall 5 which is opposite the nozzle.

A slag-free ferrochromium melt is poured 7 at a suitable velocity from a certain height into the injection ladle 1. It must be noted that increasing the pouring velocity and the pouring height increases the impulse of the melt flow 7, which for its part makes the mixing more effective. Excessive increase of the pouring velocity causes interruptions in the melt flow 7 and thereby has an adverse effect on the final result.

The injection of the reagent-gas suspension is started simultaneously with the pouring. This ensures that the nozzle 9 remains open and at the same time the mixing is at its most effective at the very initial stage (cf. FIG. 1).

The melt is thus poured on the side opposite to the injection nozzle 9, whereby the melt and the reagent are vigorously mixed and consequently a high efficiency ratio of sulfur removal to reagent is achieved. When the process continues, the melt quantity (also the melt height h) increases, whereby the mixing efficiency is reduced.

Nevertheless, by using optimal procedures in terms of flow mechanics, fresh melt and fresh reagent-gas suspension are caused to mix continuously with each other since the melt is capable of impinging against the suspension spray and partly penetrating it, simultaneously canceling its impulse and thereby reducing surface agitation, which can be observed some time after the discontinuation of the pouring. If the injection is continued further, strong splashing of the melt, which did not appear during the pouring, will now appear.

When the flow of carrier gas fed to the injection nozzle 9 is discontinued by closing the feeding of both the carrier gas coming along with the pulverous reagent and any additional gas brought to the nozzle, the CaO powder stops at the nozzle 9, thereby preventing escape of the melt from the ladle 1, in which case the powder-feed pipes (not shown) can be detached from the nozzle 9, and the ladle 1 is ready for transfer.

After the emptying of the injection ladle 1 the lime stopper can easily be removed from the injection nozzle 9 and the ladle 1 is ready for reuse.

Table 1 shows a compilation of the drop in the sulfur content ($\Delta S$) and the efficiency ratio of the reagent ($\eta_r$) when using:

I—a straight, tubular lancet and reagent feeding into a melt batch

II—a lancet according to Finnish Patent Application No. 3167/74, in which a gas-reagent suspension fed from the central pipe is dispersed into the melt batch by means of separate, powerful dispersion gas sprays III—a straight, tubular lancet, immersed in the melt and parallel to the melt being poured IV—a tubular lancet according to the present invention, immersed in the melt and bent countercurrently to the melt being poured (FIG. 2)

V—the method according to the present invention and the apparatus depicted in FIG. 3

From the table it can clearly be seen that the result ($\Delta S$, $\eta_r$) improves when the method changes from a straight lancet towards the method according to the present invention.

Table 1

| Method | Reference | Example | $S_i$ initial | $\Delta S/S_i$ % | $\eta_r$ % |
|---|---|---|---|---|---|
| I straight lancet, batch | Pat. Appl. 3167/74 | 1 | 0.055 | 34.5 | 1.1 |
| II dispersion lancet, batch | | 2 | 0.044 | 47.8 | 4.0 |
| | | 3 | 0.042 | 64.3 | 1.4 |
| III straight lancet, pouring | Present appl. | 1 | 0.068 | 58.8 | 2.6 |
| IV lancet with bend, pouring | | 2 | 0.071 | 64.8 | 3.1 |
| V lancet in wall, pouring | | 3 | 0.091 | 80.2 | 5.2 |
| | | 4 | 0.095 | 65.3 | 4.4 |

I—III previously known methods,

IV—V methods according to the present invention.

The invention is described below in more detail with the aid of examples:

EXAMPLE 1 (comparison)

Sulfur was removed from ferrochromium (approx. 1600°) by method III described above (Table 1) by injecting CaO powder into the injection ladle through a straight vertical lancet. The injection was started at the stage at which the level of the ferrochromium melt continuously poured into the ladle had reached the lower end of the lancet (approx. 400 mm). This parallel injection was continued until the pouring had been discontinued. The quantities and the analysis in the experiment were as follows:

| | | | | | |
|---|---|---|---|---|---|
| Metal quantity | | | | 8.6 t | |
| Reagent quantity 31.8 kg | | | | CaO /1 t FeCr | |
| Injection rate | | | | 31 kg/min | |
| Air rate | | | | 28 $m^3/h$ | |
| Metal analyses | Cr % | Si % | C % | S % | $\Delta S_M/S_M$ (initial) % |
| Before injection | 52.1 | 2.2 | 6.9 | 0.068 | |
| After injection | 52.0 | 2.0 | 6.9 | 0.028 | 58.8 |

The efficiency of the reagent was 2.6%.

EXAMPLE 2

CaO powder was injected by method IV described above and using the apparatus shown in FIG. 2, through a bent lancet into a ladle, and the pouring of ferrochromium melt into the ladle was started almost simultaneously. This simultaneity was realized so as to make it possible to lower the lancet, its tip turned through 90°, to nearly the bottom of the ladle, and thereby prevent the substantial puffing up of the reagent powder appearing in the example described above. Otherwise the procedure was as in Example 1. The conditions were as follows:

| | | | | | |
|---|---|---|---|---|---|
| Metal quantity | | | | 9.2 t | |
| Reagent quantity 30.5 kg | | | | CaO / 1 t FeCr | |
| Injection rate | | | | 30.5 kg/min | |
| Air rate | | | | 31 $m^3/h$ | |
| Metal analysis | Cr % | Si % | C % | S % | $\Delta S_M/S_M$ (initial) % |
| Before injection | 52.4 | 2.4 | 7.6 | 0.071 | |
| After injection | 52.2 | 2.3 | 7.0 | 0.025 | 64.8 |

The efficiency of the reagent was 3.1.

EXAMPLE 3

Sulfur was removed from ferrochromium using injection method V according to the invention and the ladle depicted in FIG. 3, by injecting CaO into the melt by means of air. The FeCr slag had been removed from the surface of the metal as carefully as possible.

| | | | | | |
|---|---|---|---|---|---|
| Metal quantity | | | | 8.6 t | |
| FeCr slag in injection | | | | 7.0 kg/t FeCr | |
| Reagent | | | | 29 kg/t FeCr of CaO, granule size - 1.5 mm | |
| Injection rate | | | | 32.4 kg/min | |
| Air rate | | | | 30 $m^3/h$ | |
| Metal analysis (%) | Cr | Si | C | S | $\Delta S_M/S_M$ (initial) |
| Before injection | 52.4 | 1.6 | 7.0 | 0.091 | |
| After injection | 52.2 | 2.0 | 6.7 | 0.018 | 80.2 |

The efficiency of the reagent was 5.2%.

EXAMPLE 4

Sulfur was removed from ferrochromium by the method according to Example 3, except that the FeCr slag was not carefully removed from the surface of the metal.

| | |
|---|---|
| Metal quantity | 7.9 t |
| FeCr slag in the injection | 71 kg/t FeCr |
| Reagent | 29.1 kg/t FeCr CaO |
| Injection rate | 29.8 kg/min |
| Air rate | 21 $m^3/h$ |

| Metal analysis (%) | Cr | Si | C | S | $\Delta S_M/S_M$ (initial) |
|---|---|---|---|---|---|
| Before injection | 53.0 | 1.8 | 6.7 | 0.095 | |
| After injection | 52.8 | 1.4 | 6.7 | 0.033 | 65.3 |

The efficiency of the reagent was 4.4%.

There are two principal methods for removing impurities from molten metal:

1. Causing the impurities to pass into another molten phase, usually slag.
2. Evaporation of the impurities.

The refining of impure copper has been described in, for example, (1) J. E. Stolarczyk et al., Journal of the Institute of Metals, 86 (1957), 49–58; (2) A. Asgari et al., Metallurgie, 13 (1973) 68–77.

Reference (1) describes among other things the treatment of lead-bearing copper in an anode furnace by adding sand on top of the copper and by injecting through tuyeres the oxygen necessary for the formation of lead silicates. The treatment may last up to 48 h.

Reference (2) describes among other things the refining of lead-bearing copper scrap in a converter using carbon added on the top of the copper as a roasting and reducing agent so that the lead passes into the gas phase, from which it can be separated in the form of finely-divided dust. The treatment time in molten state used in the experiments was, for example, 90 min, whereby the Pb content in the metal decreased from 3.5 to 0.30.

Also known are methods in which a slagging pulverous solid is injected into the melt by means of a carrier gas.

EXAMPLE 5 (comparison)

For the sake of comparison, lead was removed from molten copper by injecting sand into it through a tuyere by means of oxygen-enriched air. The oxygen-enrichment had been calculated so that the temperature of the melt changed with time in the most advantageous manner considering the refining of the molten copper. The refining was performed in a tip-up ladle provided with a tuyere known per se, in which case the tuyere could be kept above the melt surface before the injection. After the pouring, the ladle was turned to the injection position and the injection was started in the conventional manner.

Table 2 shows a comparison of the refining of copper according to Examples 5 and 6. The injection time was in both cases 10 min, whereafter the batch was allowed to settle for 5 min before the taking of the samples.

EXAMPLE 6 (according to the invention)

The injection was performed in accordance with FIG. 3 during the pouring of impure copper. It can be observed from Table 2 that the acceleration of the mixing effected by the pouring has especially promoted the removal of lead by evaporation.

Table 2

| | Example 5 | Example 6 |
|---|---|---|
| Impure Cu | | |
| Quantity in kg | 1250 | 1140 |
| Pb/% | 0.68 | 0.79 |
| S/% | 0.49 | 0.41 |
| O/% | 0.15 | 0.13 |
| Cu/% | 98.8 | 98.6 |
| Gas | | |
| Air quantity in $Nm^3$ | 42.0 | 40.7 |
| Oxygen quantity in $Nm^3$ | 9.2 | 9.0 |
| Oxygen enrichment in % | 35.2 | 34.7 |
| Sand | | |
| Quantity in kg | 10 | 10 |
| Refined Cu | | |
| Quantity in kg | 1220 | 1110 |
| Pb/% | 0.23 | 0.12 |
| S/% | 0.005 | 0.003 |
| O/% | 0.9 | 1.1 |
| Cu/% | 98.8 | 98.7 |
| Slag | | |
| Quantity in kg | 45 | 45 |
| Pb/% | 2.4 | 2.9 |
| Cu/% | 63.3 | 65.2 |
| $SiO_2$/% | 20.1 | 18.2 |

| | Cu | Pb | S |
|---|---|---|---|
| Distribution in % (Example 5) | | | |
| Impure Cu | 100 | 100 | 100 |
| Purified Cu | 97.1 | 33.0 | 1.0 |
| Slag | 2.9 | 12.5 | — |
| Dusts | — | 54.5 | 99.0 |
| Distributions in % (Example 6) | | | |
| Impure Cu | 100 | 100 | 100 |
| Purified Cu | 97.4 | 14.8 | 0.6 |
| Slag | 2.6 | 14.4 | — |
| Dusts | — | 70.8 | 99.4 |

What is claimed is:

1. A method for refining a melt by means of a reagent consisting essentially of a solid pulverous material and a gas, employing a reactor having side walls and a bottom comprising pouring the melt into the reactor close to one side wall thereof and simultaneously injecting the reagent under the melt surface from a side of the reactor opposite to the one near which the melt is poured in a direction substantially parallel to the reactor bottom and thereby causing the flow of the injected reagent and the flow of the melt being poured to impinge against each other from substantially opposite directions in the reactor and utilizing the kinetic falling energy of the melt for mixing the reagent with the melt and alternating agitation of the melt surface.

2. A method for refining a melt by means of a reagent consisting essentially of a solid pulverous material and a gas employing a reactor having side walls and a bottom, comprising injecting the reagent through the bottom of the reactor substantially vertically upwards, while pouring the melt downwards into the reactor in such a manner that the melt flow is approximately above a point of injection of the reagent and thereby causing the flow of injected reagent and the flow of melt being poured to impinge against each other from substantially opposite directions in the reactor and utilizing the kinetic falling energy of the melt for mixing the reagent with the melt and alternating agitation of the melt surface.

3. The method of claim 1, in which the falling height of the melt to the bottom of the reactor is increased as the melt surface rises in the reactor.

4. The method of claim 1, in which the injection of the reagent into the reactor is commenced simultaneously with or even after the commencement of the pouring of the melt.

5. The method of claim 1, in which the injection of the reagent into the reactor is discontinued simultaneously with or even before the discontinuation of the pouring of the melt.

6. The method of claim 1, in which the pulverous reagent used is a material or a mixture of materials which sinters and blocks the injection orifice when the feeding of the carrier gas is discontinued while the hot melt is still in the reactor.

* * * * *